US012193482B2

(12) United States Patent
Bogdziewicz

(10) Patent No.: US 12,193,482 B2
(45) Date of Patent: Jan. 14, 2025

(54) CONTAINER WITH PRIMARY AND SECONDARY STORAGE AREA

(71) Applicant: Altria Client Services LLC, Richmond, VA (US)

(72) Inventor: William J. Bogdziewicz, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 39 days.

(21) Appl. No.: 17/707,040

(22) Filed: Mar. 29, 2022

(65) Prior Publication Data

US 2023/0309611 A1 Oct. 5, 2023

(51) Int. Cl.
*A24F 23/00* (2006.01)
*B65D 25/04* (2006.01)
(Continued)

(52) U.S. Cl.
CPC ..... *A24F 23/00* (2013.01); *B65D 25/04* (2013.01); *B65D 43/021* (2013.01); *B65D 51/28* (2013.01); *B65D 2543/00092* (2013.01); *B65D 2543/0049* (2013.01); *B65D 2543/00546* (2013.01); *B65D 2543/00629* (2013.01); *B65D 2543/00694* (2013.01); *B65D 2543/0074* (2013.01)

(58) Field of Classification Search
CPC ..... B65D 2543/00675
See application file for complete search history.

(56) References Cited

U.S. PATENT DOCUMENTS 3,302,822 A 2/1967 Bryant
4,098,421 A 7/1978 Foster
(Continued)

FOREIGN PATENT DOCUMENTS

CA 152277 S 8/2014
EP 2956377 B1 4/2017
(Continued)

OTHER PUBLICATIONS

Notice of Allowance, dated Jan. 18, 2024, issued in U.S. Appl. No. 29/832,606.
(Continued)

*Primary Examiner* — Ernesto A Grano
*Assistant Examiner* — Symren K Sanghera
(74) *Attorney, Agent, or Firm* — Harness, Dickey & Pierce, P.L.C.

(57) ABSTRACT

The container includes a main sidewall, a first end-wall connected to a first end of the main sidewall, and a first structure, a first side of the first structure being connected to a second end of the main sidewall, the main sidewall, the first end-wall and the first structure at least partially defining a primary storage area, the first structure including a secondary sidewall extending from a second side of the first structure, and a including a protrusion extending from a first side of the cover, the protrusion being inserted within the secondary sidewall to be releasably mated with the secondary sidewall, a first central portion of the cover and a second central portion of the first structure at least partially defining a secondary storage area, a first peripheral portion of the cover and a second peripheral portion of the first structure at least partially defining a peripheral cavity.

20 Claims, 18 Drawing Sheets

(51) Int. Cl.

| | |
|---|---|
| ***B65D 43/02*** | (2006.01) |
| ***B65D 51/28*** | (2006.01) |

(56) References Cited

U.S. PATENT DOCUMENTS

| | | | | |
|---|---|---|---|---|
| 4,190,170 | A | 2/1980 | Boyd | |
| 4,606,474 | A * | 8/1986 | Dudzik | B65D 43/021 220/781 |
| 4,646,933 | A | 3/1987 | Jurczenia et al. | |
| 5,029,723 | A * | 7/1991 | Lo | B65D 43/0222 220/282 |
| 5,181,626 | A * | 1/1993 | Daenen | B65D 43/021 220/255 |
| D390,002 | S | 2/1998 | Brizard | |
| 5,752,599 | A | 5/1998 | Veltman | |
| D514,936 | S | 2/2006 | Pace et al. | |
| D515,426 | S | 2/2006 | Pace et al. | |
| D515,928 | S | 2/2006 | Pace | |
| D541,176 | S | 4/2007 | Bried | |
| 7,798,319 | B1 | 9/2010 | Bried et al. | |
| 8,079,372 | B2 | 12/2011 | Smith, IV et al. | |
| D651,519 | S | 1/2012 | Gibson et al. | |
| D664,840 | S | 8/2012 | Jones et al. | |
| 8,567,597 | B2 | 10/2013 | Gibson et al. | |
| D711,233 | S | 8/2014 | Henriksson | |
| D711,249 | S | 8/2014 | Henriksson | |
| 9,265,287 | B2 | 2/2016 | Sims et al. | |
| D756,790 | S * | 5/2016 | Henriksson | D9/504 |
| 9,497,992 | B2 | 11/2016 | Evans | |
| 9,936,729 | B2 | 4/2018 | Garcia et al. | |
| 10,463,075 | B2 | 11/2019 | Beardsall | |
| 10,815,038 | B2 * | 10/2020 | Rehders | B65D 79/02 |
| D936,362 | S | 11/2021 | Luo et al. | |
| 2008/0202956 | A1 | 8/2008 | Welk et al. | |
| 2010/0012534 | A1 | 1/2010 | Hoffman | |
| 2011/0083677 | A1 | 4/2011 | Carroll et al. | |
| 2015/0122817 | A1 | 5/2015 | Maxwell-Wood | |
| 2016/0106149 | A1 | 4/2016 | Potter et al. | |
| 2016/0214768 | A1 | 7/2016 | Landry | |
| 2016/0368670 | A1 | 12/2016 | Beardsall | |
| 2019/0239562 | A1 * | 8/2019 | Beardsall | B65D 43/0212 |
| 2022/0071280 | A1 * | 3/2022 | Patel | B65D 50/045 |
| 2023/0309611 | A1 | 10/2023 | Bogdziewicz | |

FOREIGN PATENT DOCUMENTS

| | | | | |
|---|---|---|---|---|
| GB | 6288170 | | 6/2023 | |
| KR | 2011/0007409 | A | 1/2011 | |
| WO | WO-2022049545 | A1 * | 3/2022 | A24F 23/00 |
| WO | WO-2022263038 | A1 * | 12/2022 | A24F 23/00 |

OTHER PUBLICATIONS

Eninfut aluminum container, posted at amazon.com, first available Apr. 2, 2021, retrieved on Nov. 9, 2023, online, https://www.amazon.com/Aluminum-Container-Airtight-Waterproof-Pocket-Sized/dp/B08T789MLT (Year: 2021).

Ongrok storage puck, posted at amazon.com, first available Nov. 2, 2020, retrieved on Nov. 9, 2023, online, https://www.amazon.com/ONGROK-STORAGEPK-Storage-Puck-Gold/dp/B0968QJJS6?th=1 (Year: 2020).

The puffy puppy smell proof jar, posted at amazon.com, first available Aug. 8, 2023, retrieved on Nov. 9, 2023, online, https://www.amazon.com/Ultimate-Airtight-Container-Storage-Tobacco/dp/B0CF2N9C1Z?th=1 (Year: 2023).

Green nexus storage jar, posted at amazon.com, first available Apr. 29, 2023, retrieved on Feb. 8, 2024, online, https://www.amazon.com/Green-Nexus-Travel-Storage-Protection/dp/B0C3X4YLGG?th=1 (Year: 2023).

Ozchin aluminum storage container, posted at amazon.com, first available Mar. 23, 2023, retrieved on Feb. 8, 2024, online, https://www.amazon.com/OZCHIN-Aluminum-Container-Airtight-Multipurpose/dp/BOBZCN5KVF (Year: 2023).

Sobahido pill case, posted at amazon.com, first available Nov. 10, 2023, retrieved on Feb. 8, 2024, online, https://www.amazon.com/Pill-Case-Purse-Pocket-Supplements/dp/B0CN3DYY97 (Year: 2023).

Generic snus can aluminum, posted at amazon.com, first available Mar. 3, 2023, retrieved on Feb. 8, 2024, online, https://www.amazon.com/Aluminum-Color-Layers-Snuffbox-Packaging/dp/BOBYTCZZXL (Year: 2023).

Corrected Notice of Allowability, dated Feb. 14, 2024, issued in U.S. Appl. No. 29/832,606.

* cited by examiner

CONTAINER WITH PRIMARY AND SECONDARY STORAGE AREA

BACKGROUND

Field

Example embodiments generally relate to a package with a primary and secondary storage area.

Description of Related Art

Packages can be used to store, transport and sell consumer products. The consumer products may need to be disposed of following consumption.

SUMMARY

At least one example embodiment is directed toward a container.

In at least one example embodiment, the container includes a main sidewall; a first end-wall connected to a first end of the main sidewall; and a first structure, a first side of the first structure being connected to a second end of the main sidewall, the main sidewall, the first end-wall and the first structure at least partially defining a primary storage area, the first structure including a secondary sidewall extending from a second side of the first structure; and a cover, the cover including a protrusion extending from a first side of the cover, the protrusion being inserted within the secondary sidewall to be releasably mated with the secondary sidewall, a first central portion of the cover and a second central portion of the first structure at least partially defining a secondary storage area, a first peripheral portion of the cover and a second peripheral portion of the first structure at least partially defining a peripheral cavity.

In at least one example embodiment, the first central portion includes the protrusion and a first central end-wall of the cover, and the second central portion includes the secondary sidewall and a second central end-wall of the first structure.

In at least one example embodiment, the protrusion is configured to be removable from within the secondary sidewall to selectively detach the cover from the first structure to allow access for the secondary storage area.

In at least one example embodiment, the cover is configured to be selectively removable from the first structure to allow access for the secondary storage area.

In at least one example embodiment, the first peripheral portion includes a brim of the cover, and the second peripheral portion includes a secondary end-wall, a first wall and a second wall, the first wall and the second wall extending from respective ends of the secondary end-wall.

In at least one example embodiment, the first structure includes an annular surface on a distal end of the second wall, a second side of the cover being flush with the annular surface.

In at least one example embodiment, a first gap is defined between a distal-most end of the cover and the second wall.

In at least one example embodiment, the first structure includes an annular surface on a peripheral end of the first structure, and the annular surface is flush with a second side of the cover.

In at least one example embodiment, the first peripheral portion cantilevers over at least a portion of the peripheral cavity, the peripheral cavity being around a periphery of the secondary storage area.

In at least one example embodiment, the first structure includes an annular ridge between the secondary storage area and the peripheral cavity, the secondary sidewall being connected to the annular ridge.

In at least one example embodiment, the first peripheral portion cantilevers over the annular ridge and the peripheral cavity.

In at least one example embodiment, the cover and the first structure are configured to allow a first edge of a second side of the cover to be pressed in an inward direction toward the peripheral cavity to cause a second edge of the cover to rise, as the annular ridge acts as a fulcrum that provides a counteracting force against the first side of the cover, to assist in detaching the cover from the first structure.

In at least one example embodiment, a gap exists between a distal-most end of the protrusion and a second central end-wall of the first structure to allow the cover and the protrusion to pivot as the first edge is pressed in the inward direction.

In at least one example embodiment, the peripheral cavity is an annularly shaped cavity that is around a periphery of the secondary storage area.

In at least one example embodiment, an outer surface of the protrusion defines an annular ridge and an inner surface of the secondary sidewall includes at least one lug, the at least one lug being configured to mate with the annular ridge to lock the cover onto the first structure.

In at least one example embodiment, the protrusion is a cylindrically shaped wall that is hollow.

In at least one example embodiment, the main sidewall and the first end-wall collectively form a base, and the cover and the first structure collectively form a lid, the lid being configured to be removed from the base to allow access to the primary storage area.

In at least one example embodiment, the main sidewall and the first structure collectively form a base.

In at least one example embodiment, the container further includes outer sidewalls extending from the first end-wall, the outer sidewalls and the first end-wall collectively forming a lid, the lid being configured to be removed from the base to allow access to the primary storage area, the first structure and the lid being on opposite ends of the container.

In at least one example embodiment, the container further includes oral consumer products contained within the primary storage area.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
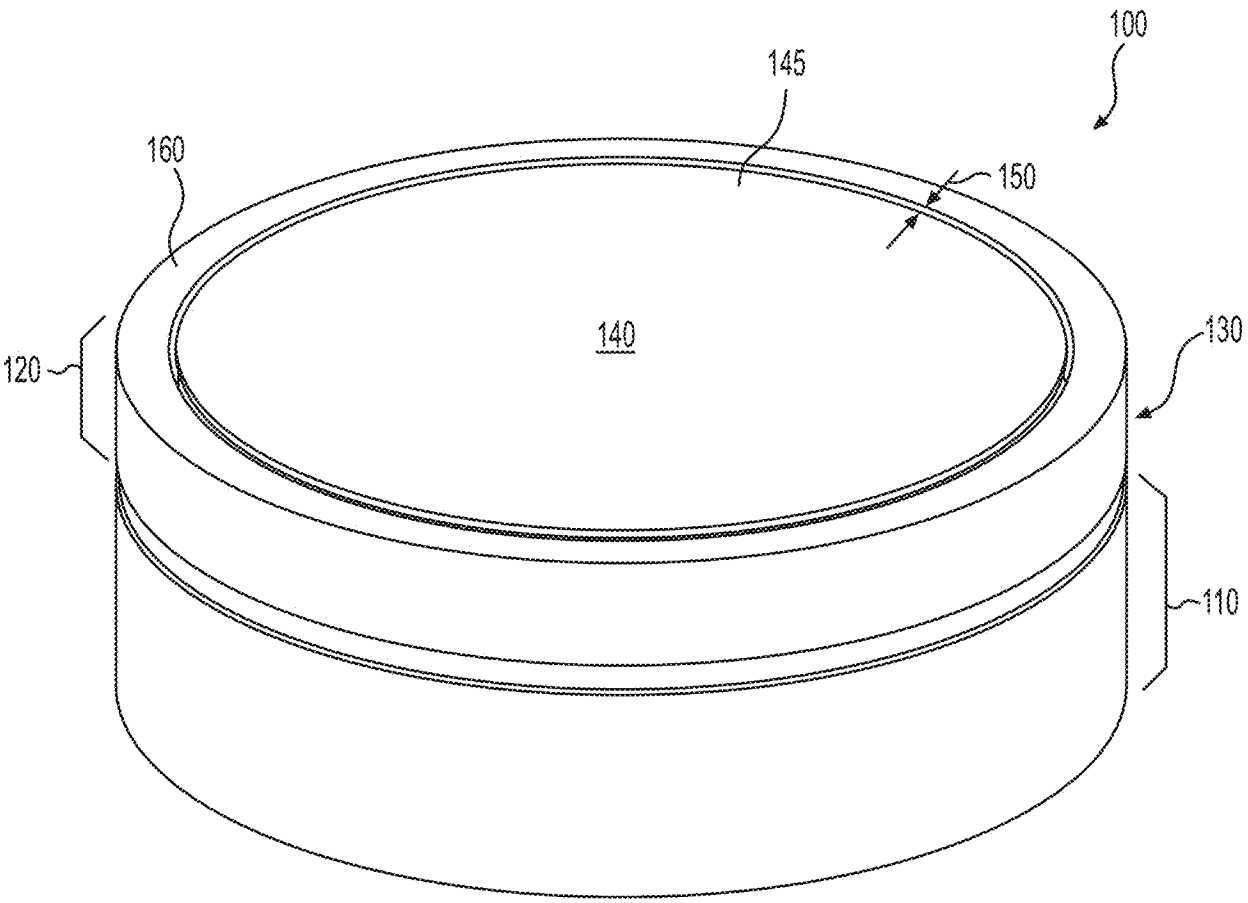
FIG. 1 is an illustration of a perspective view of a container, in accordance with at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

FIG. 1 is an illustration of a perspective view of a container (package) 100, in accordance with an example embodiment.

In at least one example embodiment, the container 100 includes a base 110 with a lid 120. In at least one example embodiment, the lid 120 includes an end-covering (first structure) 130 and a cover (insert) 140 (see FIGS. 6 and 7). In at least one example embodiment, the cover 140 fits onto the end-covering 130 (lower portion of the lid 120), where an outer surface 145 of the cover 140 is substantially flush with an annular surface 160 of the end-covering 130. In at least one example embodiment, a gap 150 exists between the outer surface 145 of the cover 140 and the annular surface 160.

Figure 2:
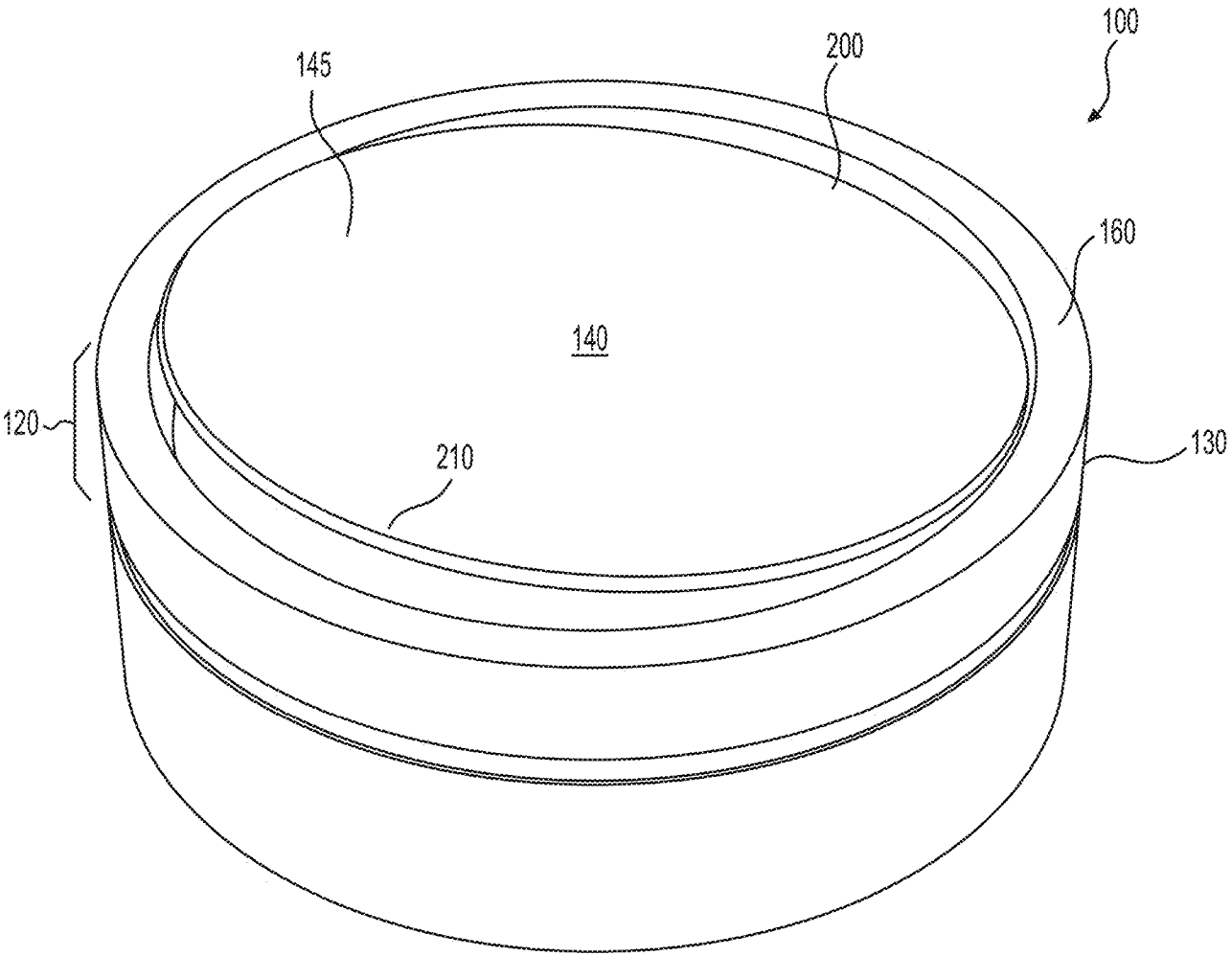
FIG. 2 is an illustration of a perspective view of the container, where a cover of an end-covering is in a partially opened configuration, in accordance with at least one example embodiment.

FIG. 2 is an illustration of a perspective view of the container 100, where the end-covering 130 is in a partially opened configuration, in accordance with an example embodiment.

In at least one example embodiment, the cover 140 is seated within the end-covering 130 so that the cover 140 can be popped open. In this example embodiment, if a pressing (downward) force is applied to a peripheral portion (first end) 200 of the outer surface 145 of the cover 140, then an opposing peripheral portion (second end) 210 of the cover 140 pops up (rises) relatively easily, in order to assist in the opening of the cover 140.

Figure 3:
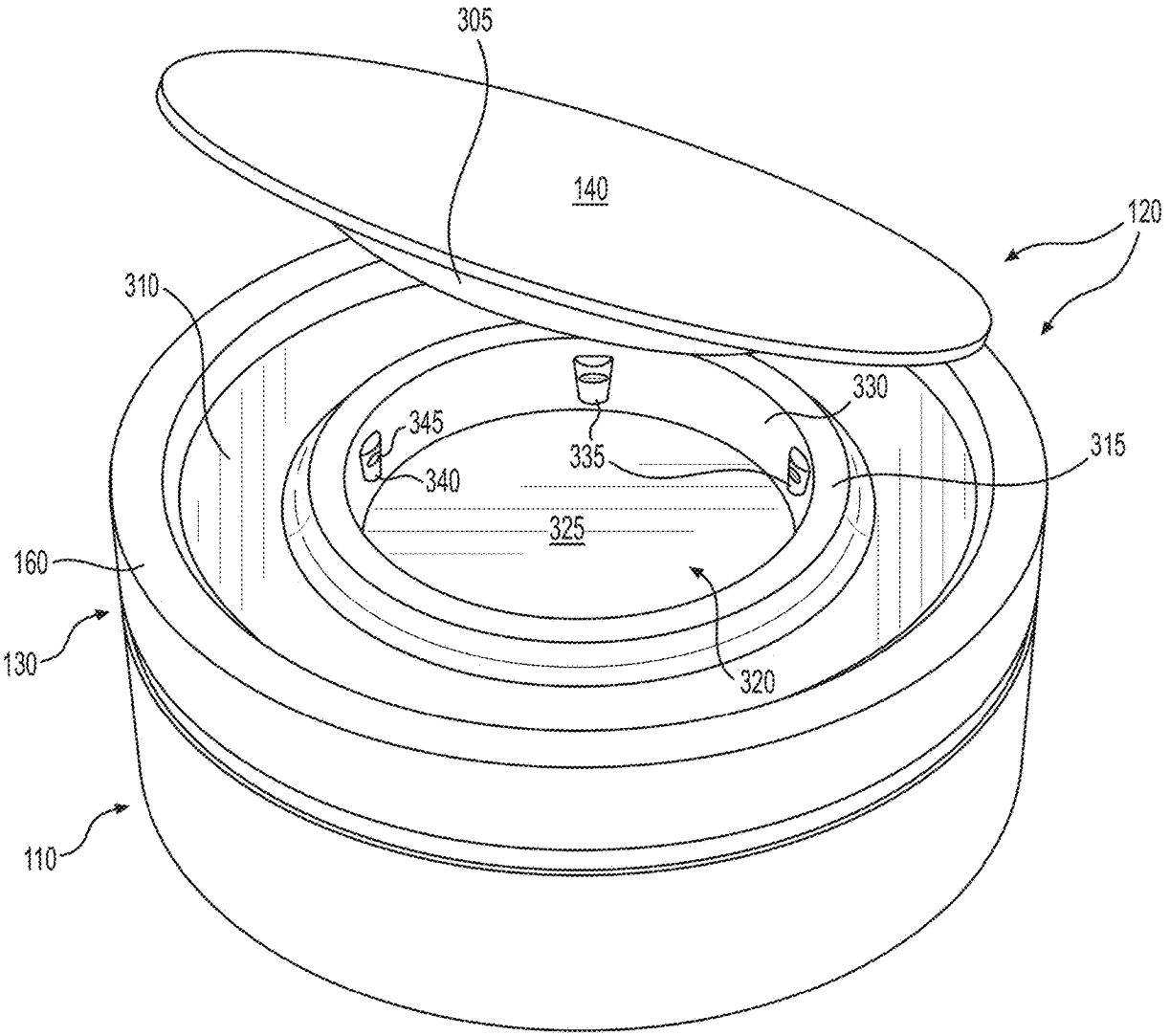
FIG. 3 is an illustration of a perspective view of the container, where the cover of the end-covering is in an opened configuration, in accordance with at least one example embodiment.

FIG. 3 is an illustration of a perspective view of the container 100, where the end-covering 130 is in an opened configuration, in accordance with an example embodiment.

Figure 4:
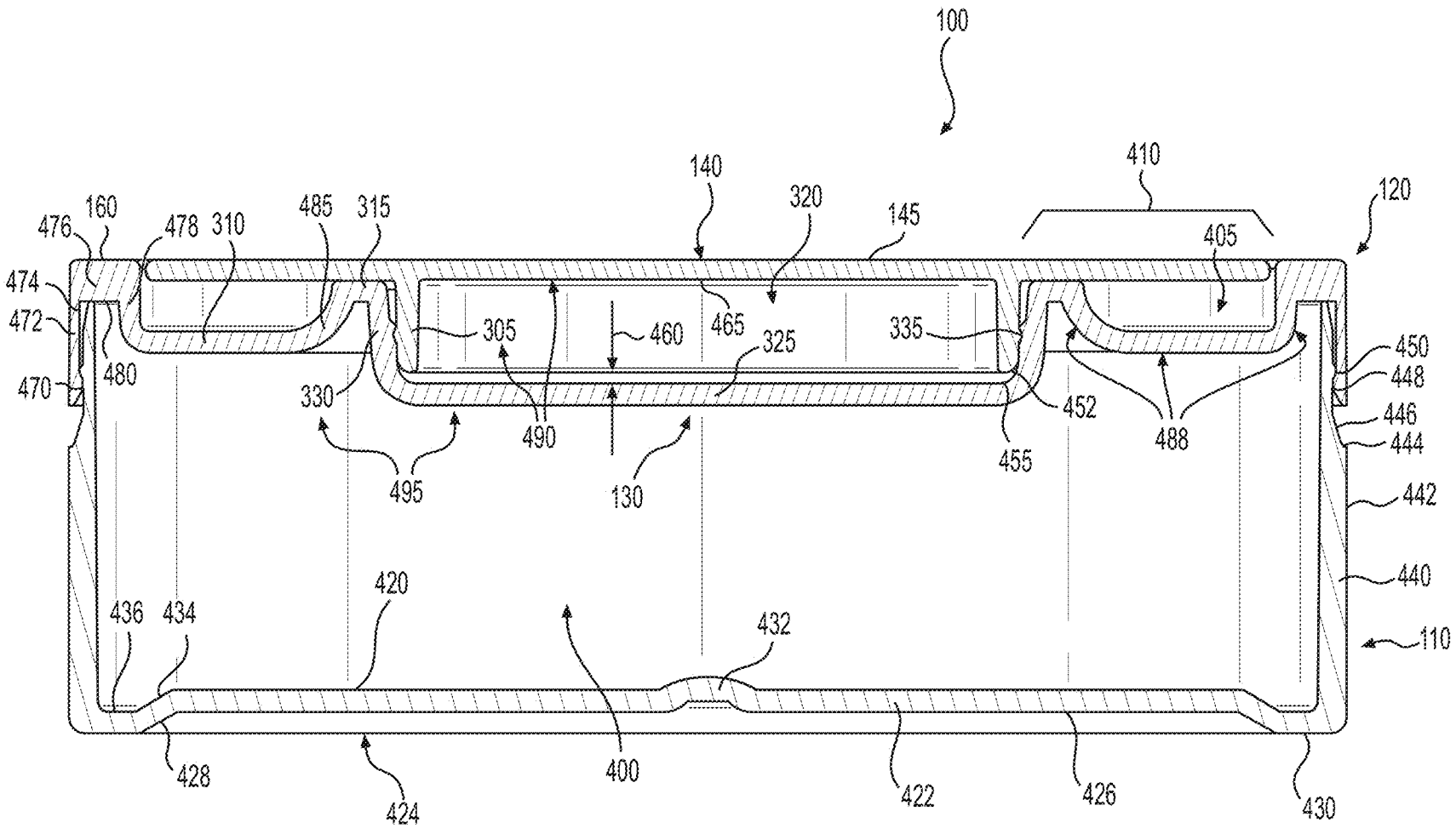
FIG. 4 is an illustration of a vertical cross-sectional view of the container, in accordance with at least one example embodiment.

In at least one example embodiment, the end-covering 130 at least partially defines a secondary storage area 320. In at least one example embodiment, the cover 140 includes a protrusion 305 that fits into, and mates with, a secondary sidewall 330 of the end-covering 130 so that the cover 140 is able to be firmly secured on the end-covering 130 (also see FIG. 4). In at least one example embodiment, the cover 140 closes over the end-covering 130, so that the end-covering 130 and the cover 140 collectively define the secondary storage area 320 (FIG. 4). In at least one example embodiment, the secondary storage area 320 is defined in part by a central floor 325 and the secondary sidewall 330 of the end-covering 130. In at least one example embodiment, the central floor 325 is circular in shape.

In at least one example embodiment, the secondary sidewall 330 includes lugs 335 extending from a surface of the secondary sidewall 330. In at least one example embodiment, each of the lugs 335 includes a front face 340 that defines a notch 345. As explained in better detail in FIG. 5, in at least one example embodiment, the lugs 335 assist in locking the cover 140 onto the end-covering 30.

In at least one example embodiment, a peripheral portion 410 (FIG. 4) of the cover 140 cantilevers over (overhangs) a secondary floor 310 of the end-covering. In at least one example embodiment, an annular ridge 315 of the end-covering 130 acts as a fulcrum, and the peripheral portion (outer end) 410 cantilevers over the secondary floor 310 (see FIG. 4).

Figure 5:
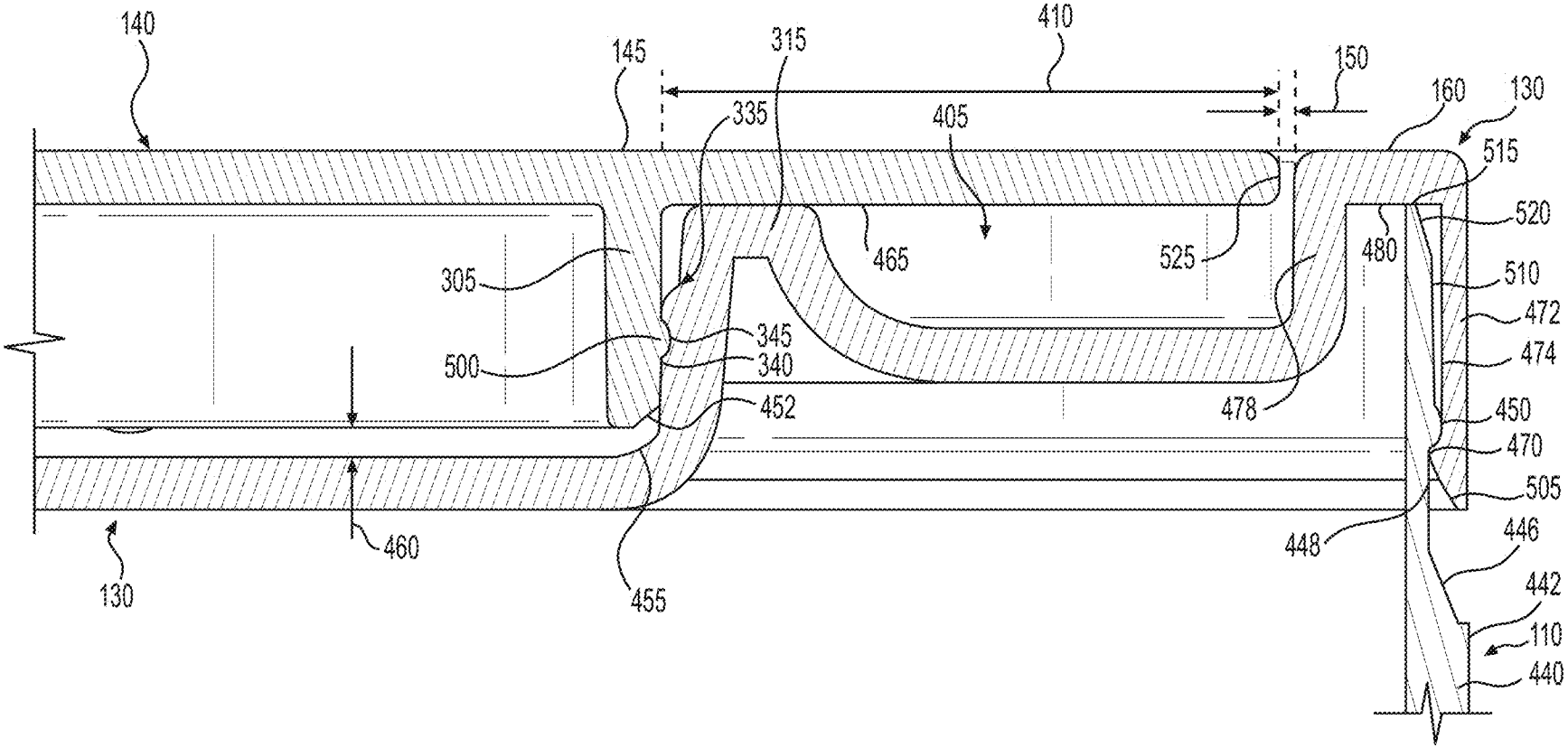
FIG. 5 is an illustration of a close-up view of a portion of a cover and an end-covering of the container, in accordance with at least one example embodiment.

FIG. 4 is an illustration of a vertical cross-sectional view of the container 100, in accordance with an example embodiment. FIG. 5 is an illustration of a close-up view of a portion of the cover 140 and the end-covering 130 of the container 100, in accordance with an example embodiment.

In at least one example embodiment, the lid 120 fits over a top of the base 110, where the end-covering 130 and the base 110 form a primary storage area 400. In at least one example embodiment, the cover 140 can be connected to the end-covering 130 to define the secondary storage area 320. In at least one example embodiment, a central portion 490 of the cover 140 and a central portion 495 of the end-covering 130 combine to at least partially define the secondary storage area 320. In at least one example embodiment, the central portion 490 of the cover 140 includes an interior of the protrusion 305 and an interior of a center portion (central end-wall) of the cover 140 (where the interior of the center portion of the cover 140 is encompassed by the protrusion 305). In at least one example embodiment, the central portion 495 of the end-covering 130 includes an interior of the secondary sidewall 330 and the central floor (central end-wall) 325.

In at least one example embodiment, the protrusion 305 extends from an inner surface 465 of the cover 140. In at least one example embodiment, a ridge 500 runs along an outer surface of the protrusion 305. In at least one example embodiment, at least a portion of the ridge 500 mates with the notch 345 of the lugs 335 of the secondary sidewall 330 to help securely connect the cover 140 to the end-covering 130. In at least one example embodiment, a gap 460 between an edge (distal-most end) 452 of the protrusion 305 and the central floor 325 allows the protrusion 305 to pivot as the first end 200 of the cover 140 is pressed inward to pop up the cover 140 open (see FIG. 2). In at least one example embodiment, an edge 455 of the end-covering 130, at a seam between the central floor 325 and the secondary sidewall 330, is rounded. In at least one example embodiment, the edge 452 of the protrusion 305 is beveled or rounded to conform the edge 452 of the protrusion 305 to a shape of the edge 455 of the end-covering 130. In at least one example embodiment, the central floor 325 extends to a lower elevation (extends further into the primary storage area 400), relative to the secondary floor 310.

In at least one example embodiment, the end-covering 130 and the cover 140 define a peripheral cavity 405. In at least one example embodiment, the peripheral portion (brim) 410 of the cover 140 and a peripheral portion 488 of the end-covering 130 combine to at least partially define the peripheral cavity 405. In at least one example embodiment, the peripheral portion 488 of the end-covering 130 includes the secondary floor 310, a vertical wall 478 and a sloped wall 485. In at least one example embodiment, the peripheral cavity 405 is around a periphery of the secondary storage area 320. In at least one example embodiment, the peripheral cavity 405 is an annular cavity that encompasses the secondary storage area 415. In at least one example embodiment, the gap 150 is defined between a distal-most end 525 of the cover 140 and the vertical wall 478 of the end-covering 130.

In at least one example embodiment, the annular ridge 315 of the end-covering 130 provides a fulcrum for the cover 140, during the opening of the cover 140. Specifically, in at least one example embodiment, the annular ridge 315 allows the first end 200 of the cover 140 to be pressed downward causing the peripheral portion 410 of the first end 200 to be pressed into the peripheral cavity 405, where the fulcrum action of the annular ridge 315 applies a force to the inner surface 465 of the cover 140 that causes the second end 210 of the cover 140 to pop up (FIG. 2).

In at least one example embodiment, the sloped wall 485 and the vertical wall 478 extend from ends of the secondary floor 310 to partially define the peripheral cavity 405. In at least one example embodiment, the peripheral cavity 405 is partially defined by the peripheral portion 410 of the cover 140. In at least one example embodiment, the peripheral cavity 405 is not sealed at least due to the gap 150 (FIG. 1). In at least one example embodiment, the gap 150 allows for a tolerance between the cover 140 and the end-covering 130, so that the cover 140 can pivot or tilt (FIG. 2), while the cover 140 is being opened. In at least one example embodiment, the vertical wall 478 extends upward to an annular wall 476, where the annular surface 160 of the annular wall 476 is a top surface of the end-covering 130. In at least one example embodiment, spokes 480 extend from a lower end of the annular wall 476 (also see FIG. 11).

In at least one example embodiment, the end-covering 130 includes an outer sidewall 472 (also see FIG. 11) that extends downward from the annular surface 160. In at least one example embodiment, the outer sidewall 472 extends along an outer periphery of a main sidewall 440 of the base 110, when the lid 120 is locked onto the base 110. In at least one example embodiment, an inner surface 474 of the outer sidewall 472 includes a ridge 470 (also see FIGS. 5 and 12). In at least one example embodiment, the ridge 470 fits over and mates with a ridge 450 of the main sidewall 440 of the base 110. In at least one example embodiment, the ridge 450 of the end-covering 130 extends away from a first vertical surface 448 of the main sidewall 440 of the base 110, where the ridge 470 rests against the first vertical surface 448 once the lid 120 is locked onto the base 110 (see FIG. 5). In at least one example embodiment, the outer surface 442 of the main sidewall 440 defines a step 444, where an inclined surface 446 is between the step 444 and the first vertical surface 448. In at least one example embodiment, a second vertical surface 510 and an inclined (beveled) surface 520 are above a location of the ridge 450 on the outer surface 442 of the main sidewall 440 (FIG. 5). In at least one example embodiment, the end-covering 130 rests on an upper rim 515 of the base 110, when the lid 120 is locked onto the base 110.

Returning to FIG. 4, in at least one example embodiment, the base 110 includes a floor (end-wall) 422 that partially defines the primary storage area 400. In at least one example embodiment, the floor 422 includes an inner surface 420 that defines an inclined surface 434 and a trench 436. In at least one example embodiment, the trench 436 is an annular trench that is defined along a periphery of the floor 422 of the base 110 (also see FIG. 9). In at least one example embodiment, the floor 422 defines a dimple 432 at an epicenter of the floor 422 of the base 110 (also see FIG. 9).

In at least one example embodiment, the floor 422 of the base 110 includes lower surfaces that define a recessed area 424. Specifically, in at least one example embodiment, the lower surfaces include a lower central surface 426, an inclined surface 428 and a lower annular surface 430, where the inclined surface 428 is between the lower central surface 426 and the lower annular surface 430 (also see FIG. 10). In at least one example embodiment, the lower annular surface 430 is at a lower elevation than the lower central surface 426 on the container 100.

In at least one example embodiment, the outer sidewall 472 of the end-covering 130 includes an inclined surface 505. In at least one example embodiment, the inclined surface 505 allows the outer sidewall 472 to be tilted, where the inclined surface 505 can press against the first vertical surface 448 of the main sidewall 440 of the base 110, as the end-covering 130 is tilted to remove the end-covering 130 from the base 110.

Figure 6:
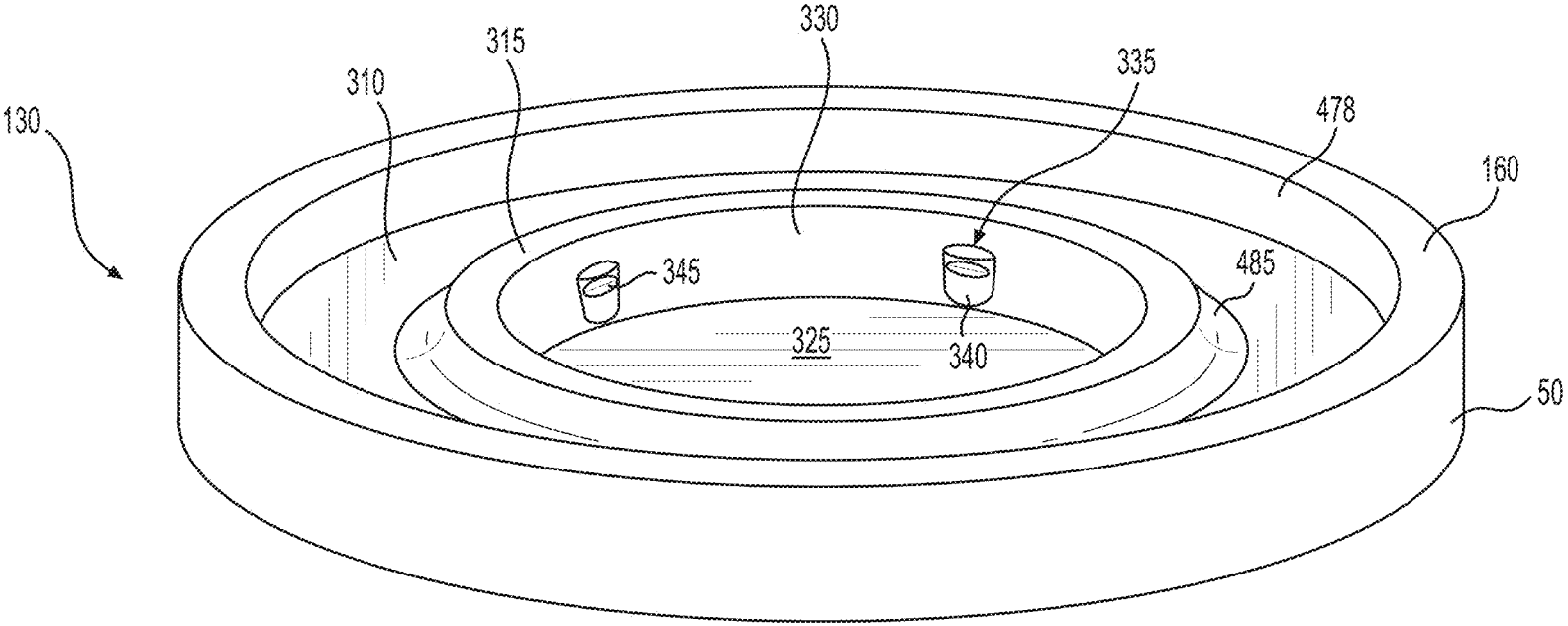
FIG. 6 is an illustration of a perspective view of the end-covering of the container, in accordance with at least one example embodiment.
Figure 7:
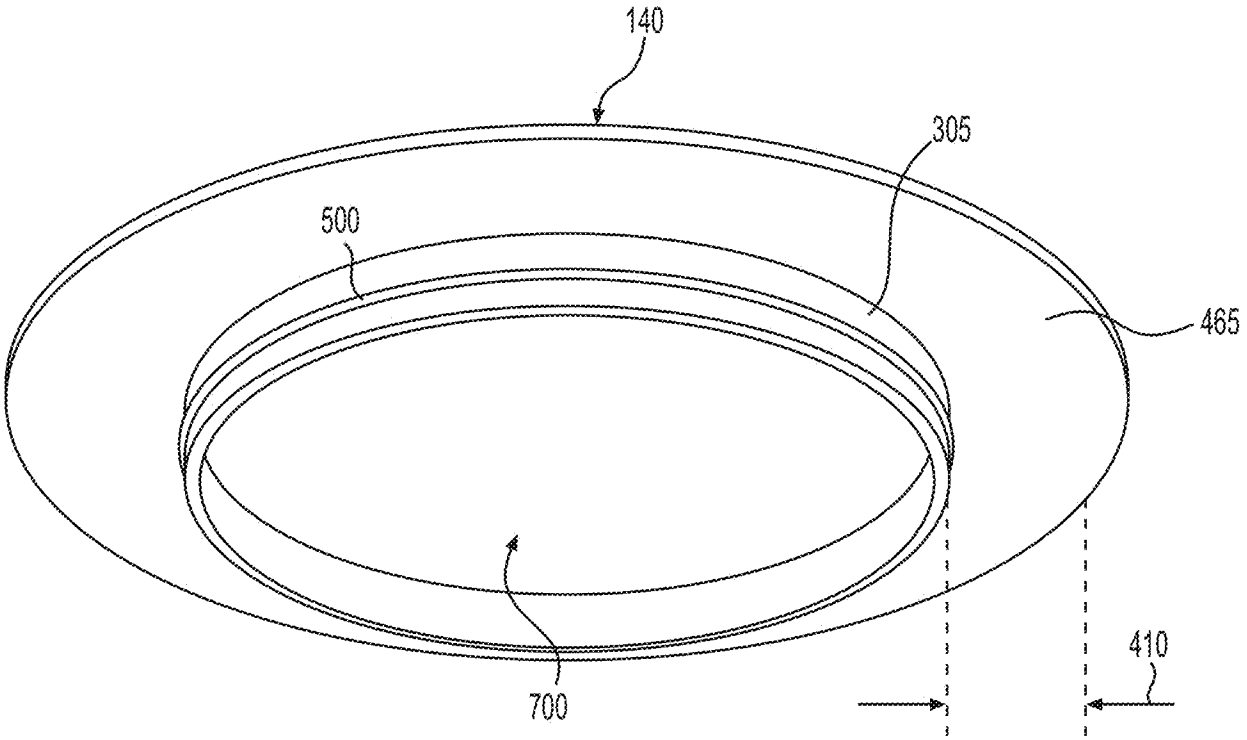
FIG. 7 is an illustration of a perspective view of a cover of the container, in accordance with at least one example embodiment.

FIG. 6 is an illustration of a perspective view of the end-covering 130 of the container 100, in accordance with an example embodiment. FIG. 7 is an illustration of a perspective view of the cover 140 of the end-covering 130 (also see FIG. 4), in accordance with an example embodiment.

In at least one example embodiment, three or more of the lugs 335 extend from the secondary sidewall 330 of the end-covering 130. In at least one example embodiment, the ridge 500 is an annular ridge that extends continuously around the periphery of the protrusion 305 of the cover 140. In at least one example embodiment, the notch 345 of each of the lug 335 mates with the ridge 500 to securely connect the cover 140 to the end-covering 130. In at least one example embodiment, the notch 345 is an oval shaped notch, as shown in FIG. 6. Other shapes of the notch 345 are contemplated. In at least one example embodiment, four of the lugs 335 extend from the secondary sidewall 330. In at least one example embodiment, the lugs 335 are spaced equidistantly around the secondary sidewall 330. In at least one example embodiment, the secondary sidewall 330 includes a single lug 335.

In at least one example embodiment, the protrusion 305 is a cylindrically shaped wall that extends from the inner surface 465 of the cover 140. In at least one example embodiment, the protrusion 305 is hollow (open cavity 700) inside, as shown in FIG. 7.

In at least one example embodiment, the primary storage area 400 is used to contain a consumer product. In at least one example embodiment, the consumer product includes pouches of an oral product. In at least one example embodiment, the secondary storage area 320 is left empty so that a spent product can be retained in the secondary storage area 320 for disposal, or prior to disposal.

In at least one example embodiment, the primary storage area 400 contains a first consumer product, and the secondary storage area 320 contains a second consumer product. In at least one example embodiment, the first consumer product and the second consumer product are different products. In at least one example embodiment, the second consumer product is a sample or a bonus product. In at least one example embodiment, the first consumer product and the second consumer product are a same product.

In at least one example embodiment, the oral product may be a tobacco product or a non-tobacco product. The oral product may include chewing tobacco, snus, moist snuff tobacco, dry snuff tobacco, or other smokeless tobacco and non-tobacco products for oral consumption. A smokeless tobacco product may include tobacco that is whole, shredded, cut, granulated, reconstituted, cured, aged, fermented, pasteurized, or otherwise processed. Tobacco may be present as portions of leaves, flowers, roots, stems, extracts, or any combination thereof. In at least one example embodiment, the oral product includes a tobacco extract, such as a tobacco-derived nicotine extract (e.g., white snus) alone or in combination with non-tobacco cellulosic materials (e.g., microcrystalline cellulose (MCC). Where the oral product includes nicotine, with or without tobacco, the nicotine may be tobacco-derived nicotine or synthetic nicotine. The oral product may be provided loose, in a pouch, as a plug or twist, or in a desired shape. The oral product may be in the form of lozenges, chews, gums, pouches, sticks, tablets, pastilles, or any other suitable form.

The oral product may have various ranges of moisture. In at least one example embodiment, the oral product is a dry oral product having a moisture content ranging from 5% by weight to 10% by weight. In at least one example embodiment, the oral product has a medium moisture content, such as a moisture content ranging from 20% by weight to 35% by weight. In at least one example embodiment, the oral product is a wet oral product having a moisture content ranging from 40% by weight to 55% by weight.

In at least one example embodiment, the tobacco product may include smokeless tobacco pouches. In at least one example embodiment, the non-tobacco product may include herbal compositions, pharmaceutical medications, or other non-tobacco products. Herbs and other edible plants can be categorized generally as culinary herbs (e.g., thyme, lavender, rosemary, coriander, dill, mint, peppermint) and medicinal herbs (e.g., Dahlias, Cinchona, Foxglove, Meadowsweet, *Echinacea*, Elderberry, Willow bark). In some example embodiments, the non-tobacco products may include *cannabis* or *cannabis* extracts.

Figure 8:
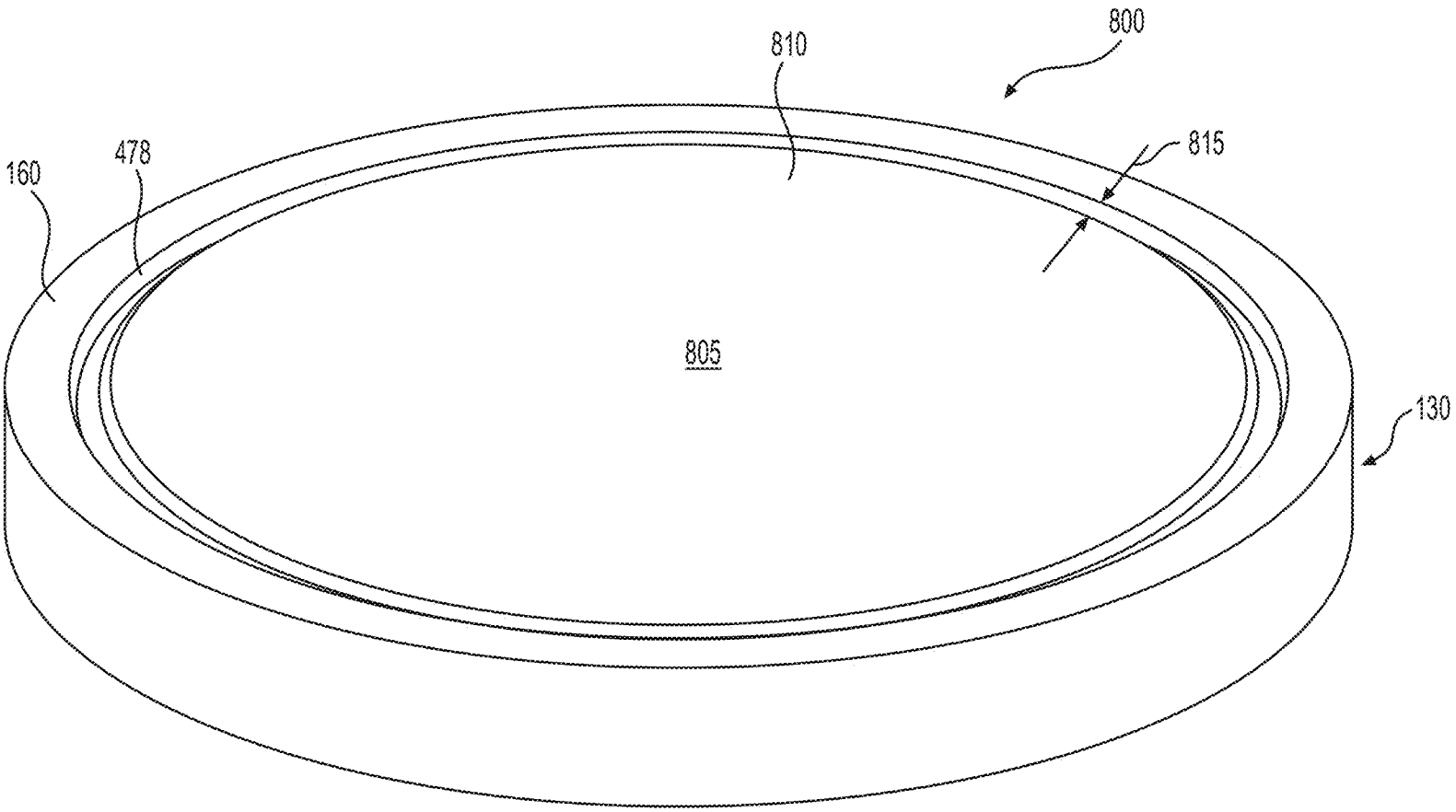
FIG. 8 is an illustration of a perspective view of another lid of the container, in accordance with at least one example embodiment.

FIG. 8 is an illustration of a perspective view of another lid 800 of the container 100, in accordance with an example embodiment.

In at least one example embodiment, the lid 800 is the same as the lid 120, except for the following differences. In at least one example embodiment, the lid 800 includes a cover 805 with a smaller diameter, as compared to the cover 140 of FIG. 1. In this example embodiment, an outer surface 810 of the cover 805 has a larger gap 815, as compared to the gap 150 of FIG. 1. In at least one example embodiment, the cover 805 fits onto the end-covering 130 in the same manner as the cover 140 (see FIG. 4).

Figure 9:
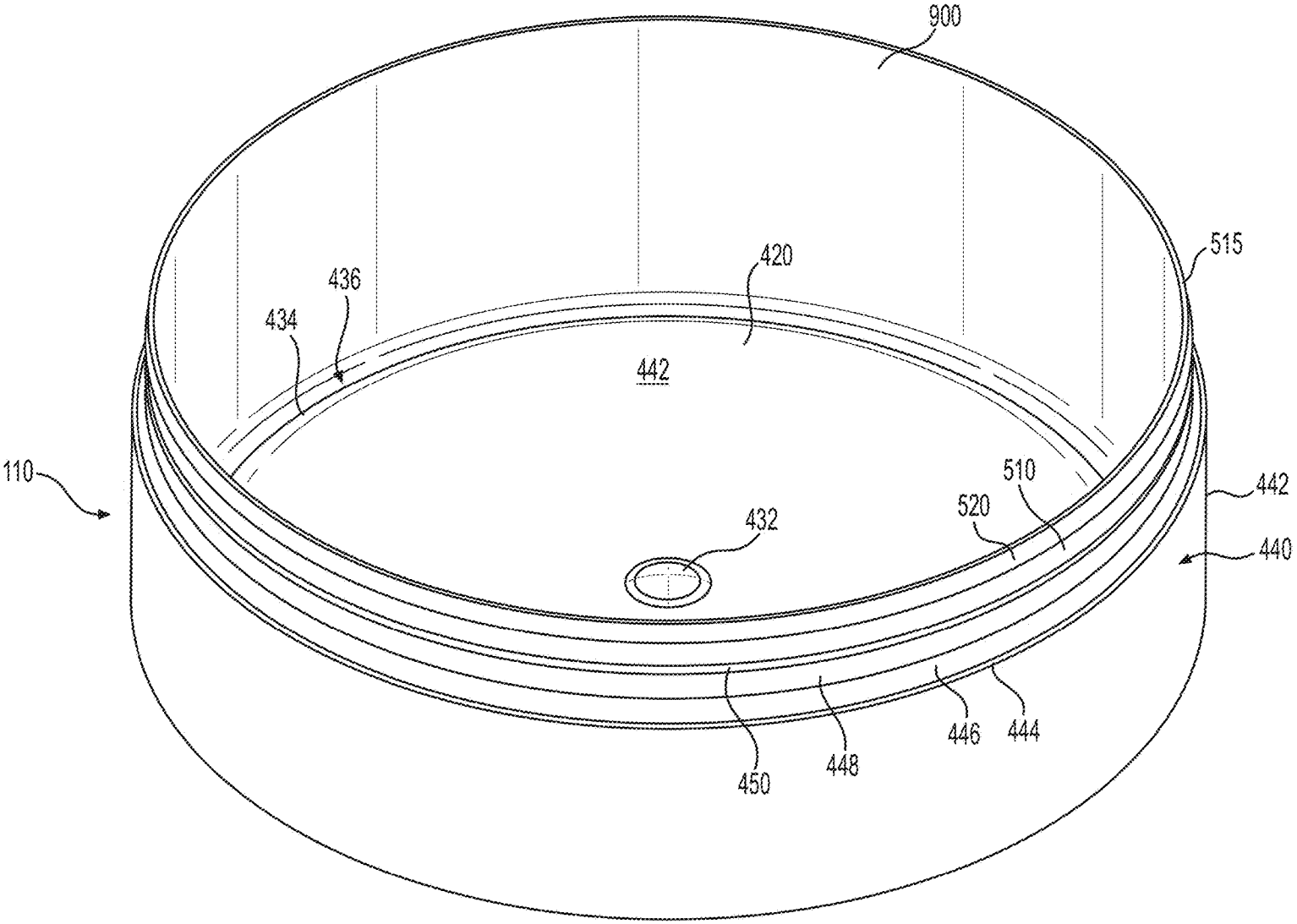
FIG. 9 is an illustration of an upper perspective view of a base of the container, in accordance with at least one example embodiment.
Figure 10:
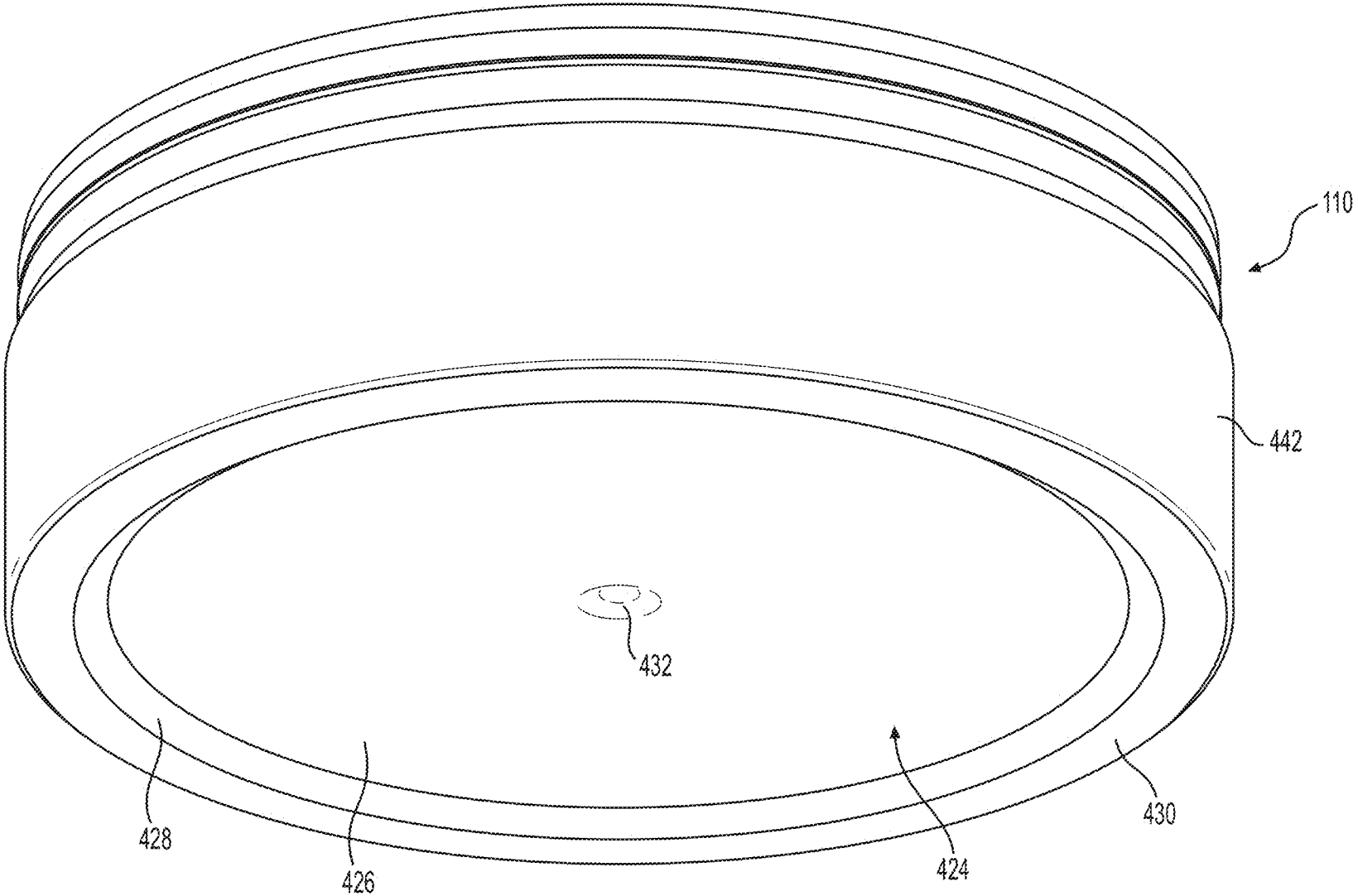
FIG. 10 is an illustration of a lower perspective view of the base of the container, in accordance with at least one example embodiment.

FIG. 9 is an illustration of an upper perspective view of the base 110 of the container 100, in accordance with an example embodiment. FIG. 10 is an illustration of a lower perspective view of the base 110 of the container 100, in accordance with an example embodiment.

In at least one example embodiment, the base 110 includes an inner surface 900 of the main sidewall 440 that is substantially vertical. In at least one example embodiment, the trench 436 is defined by the inclined surface 434 of the floor 422 and the inner surface 900 of the main sidewall 440. In at least one example embodiment, and as also shown in FIG. 5, the outer surface 442 of the main sidewall 440 defines the step 444, the inclined surface 446, the first vertical surface 448, the ridge 450, the second vertical surface 510 and the inclined surface 520.

In at least one example embodiment, the recessed area 424 at a lower end of the base 110 is circular. In at least one example embodiment, the inclined surface 428 provides strength to the base 110, and allows the container 100 to withstand loads, especially during stacking. In at least one example embodiment, the recessed area 424 is centrally set within the lower annular surface 430.

Figure 11:
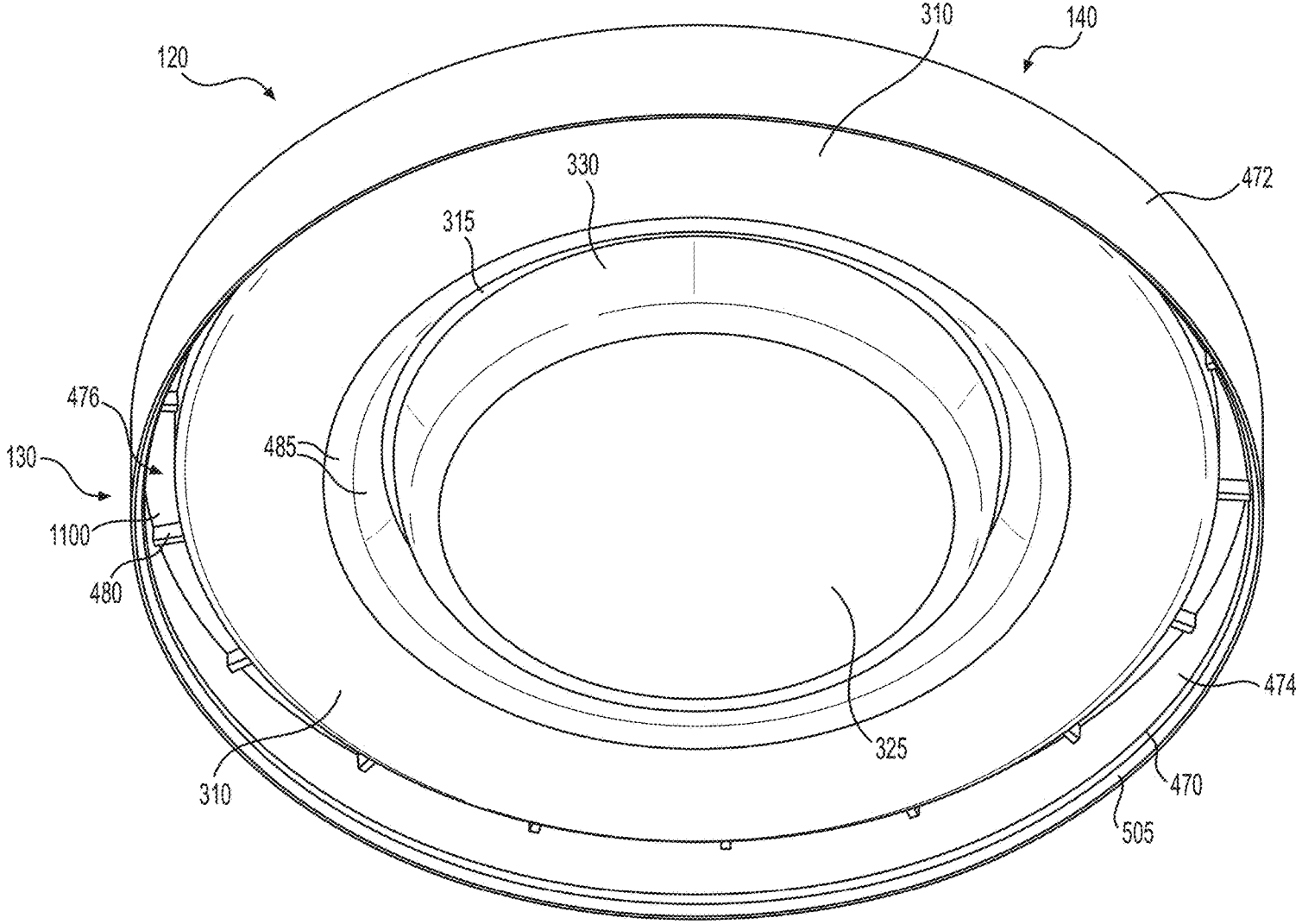
FIG. 11 is an illustration of a lower view of the lid of the container, in accordance with at least one example embodiment.
Figure 12:
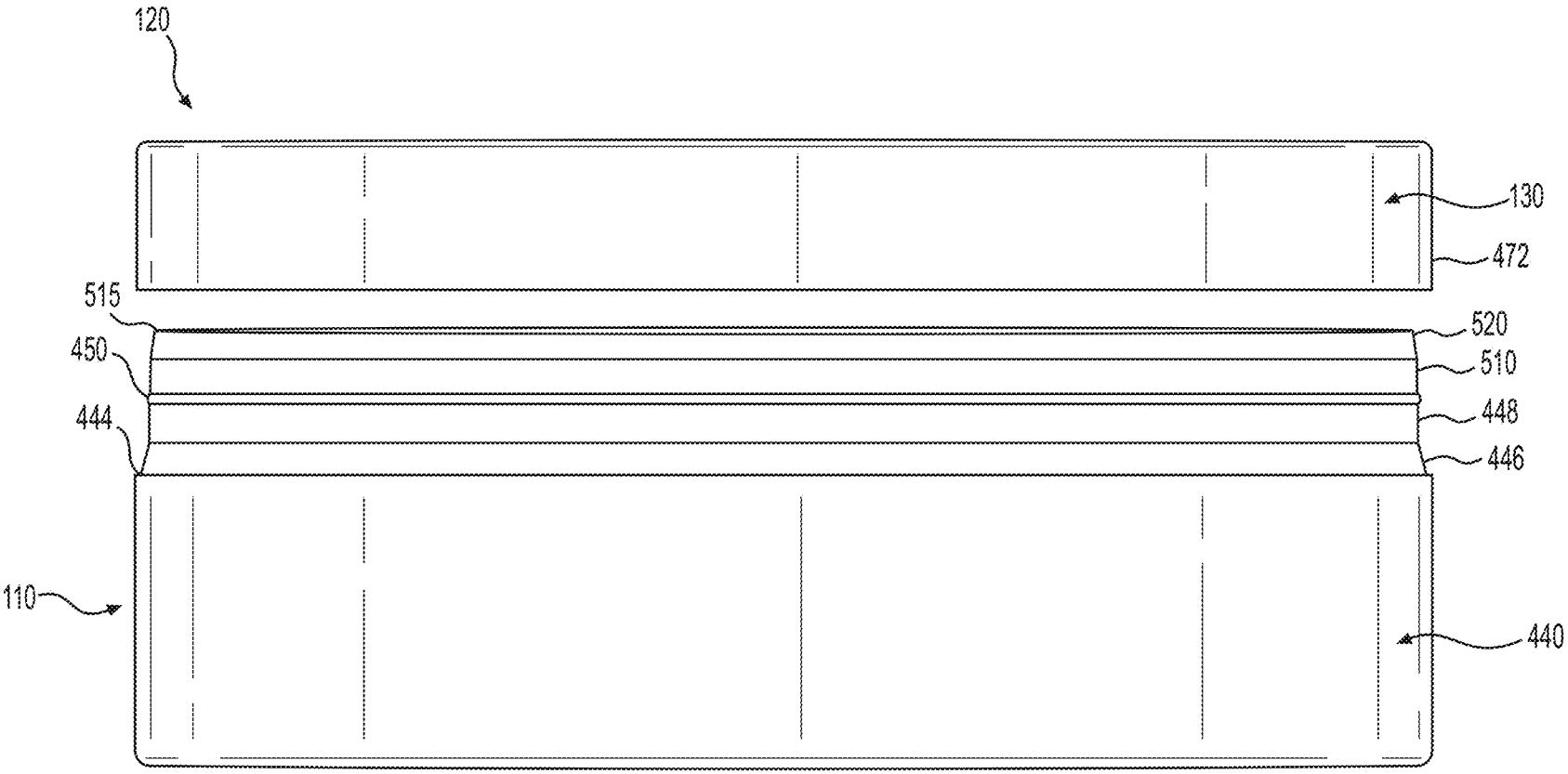
FIG. 12 is an illustration of a side view of the lid and the base of the container, in accordance with at least one example embodiment.
Figure 13:
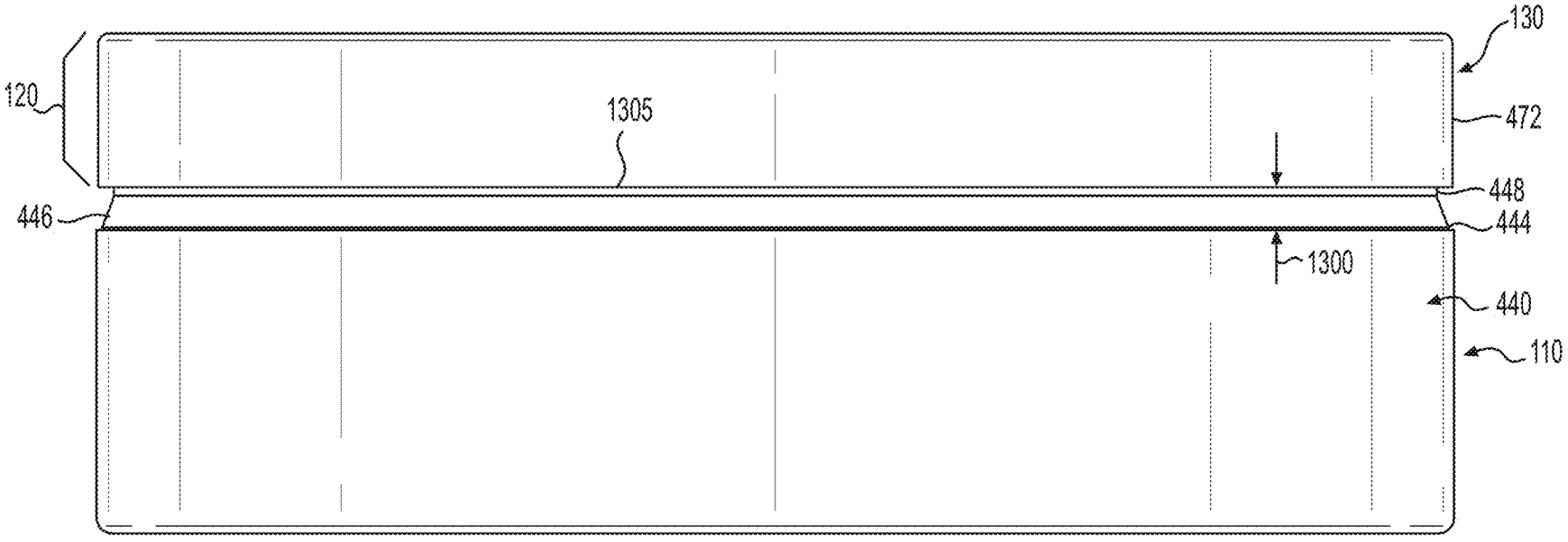
FIG. 13 is an illustration of a side view of the lid on the base of the container, in accordance with at least one example embodiment.

FIG. 11 is an illustration of a lower view of the lid 120 of the container 100, in accordance with an example embodiment. FIG. 12 is an illustration of a side view of the lid 120, in accordance with an example embodiment. FIG. 13 is an illustration of a side view of the lid 120 on the base 110 of the container 100, in accordance with an example embodiment.

In at least one example embodiment, the central floor 325 of the end-covering 130 extends downward, below a surface of the secondary floor 310 (also see FIG. 4). In at least one example embodiment, the end-covering 130 includes the spokes 480 that extend along a portion of an inner surface 1100 of the annular wall 476, where the spokes 480 extend between the vertical wall 478 and the outer sidewall 472 (see FIG. 4). In at least one example embodiment, the spokes 480 add structural strength to the end-covering 130. In at least one example embodiment, the spokes 480 help mitigate moisture from forming at, and sealing, an interface between the inner surface 465 of the annular wall 476 and the upper rim 515 of the base 110.

In at least one example embodiment, the outer sidewall 472 of the end-covering 130 of the lid 120 fits down onto an upper portion of the main sidewall 440 of the base 110. In at least one example embodiment, and as shown in at least FIG. 5, the ridge 450 of the main sidewall 440 assists in locking the lid 120 onto the base 110, where the ridge 470 on an interior of the outer sidewall 472 of the end-covering 130 fits over and mates with the ridge 450 of the base 110.

In at least one example embodiment, once the lid 120 is connected in a locked position on the base 110, a gap 1300 exists between the step 444 of the main sidewall 440 of the base 110 and a lower lip 1305 of the outer sidewall 472 of the lid 120.

Figure 14:
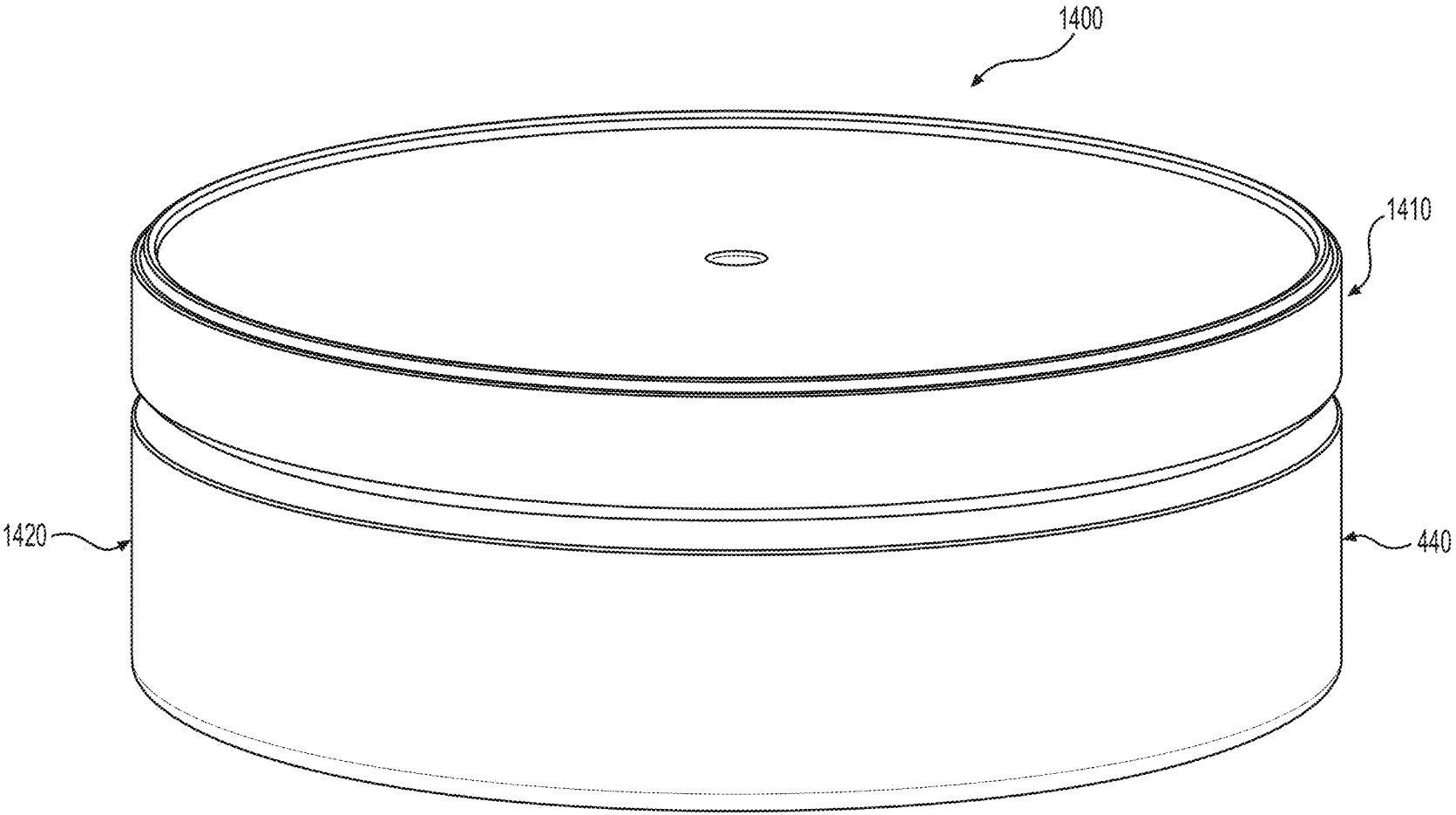
FIG. 14 is an illustration of an upper perspective view of another container, in accordance with at least one example embodiment.
Figure 15:
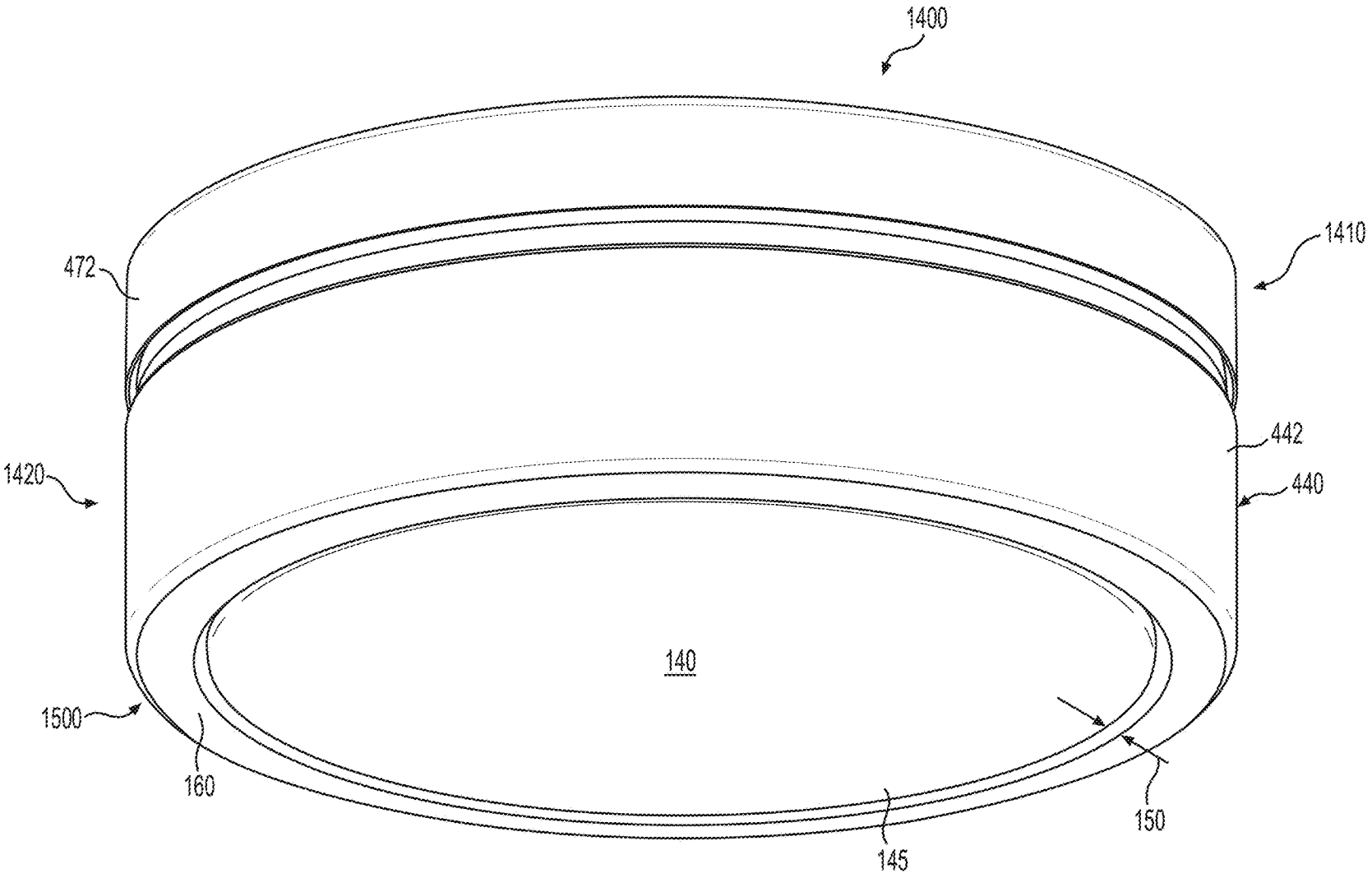
FIG. 15 is an illustration of a lower perspective view of the container of FIG. 14, in accordance with at least one example embodiment.

FIG. 14 is an illustration of an upper perspective view of another container 1400, in accordance with an example embodiment. FIG. 15 is an illustration of a lower perspective view of the container 1400 of FIG. 14, in accordance with an example embodiment.

In at least one example embodiment, the container 1400 is the same as the container 100, except for the following differences. In at least one example embodiment, the container 1400 includes a lid 1410 connected to a base 1720. In at least one example embodiment, the container 1400 includes an end-covering (first structure) 1500 on a lower end of the base 1720. In at least one example embodiment, the end-covering 1500 is an integral part of the base 1720. In at least one example embodiment, the cover 140 is connected to the end-covering 1500. In at least one example embodiment, the outer surface 145 of the cover 140 is substantially flush with the annular surface 160 of the end-covering 1500. In at least one example embodiment, the gap 150 exists between the outer surface 145 and the annular surface 160.

In at least one example embodiment, the base 1720 of the container 1400 includes the main sidewall 440 with the outer surface 442. In at least one example embodiment, the lid 1410 of the container 1400 includes the outer sidewall 472.

Figure 16:
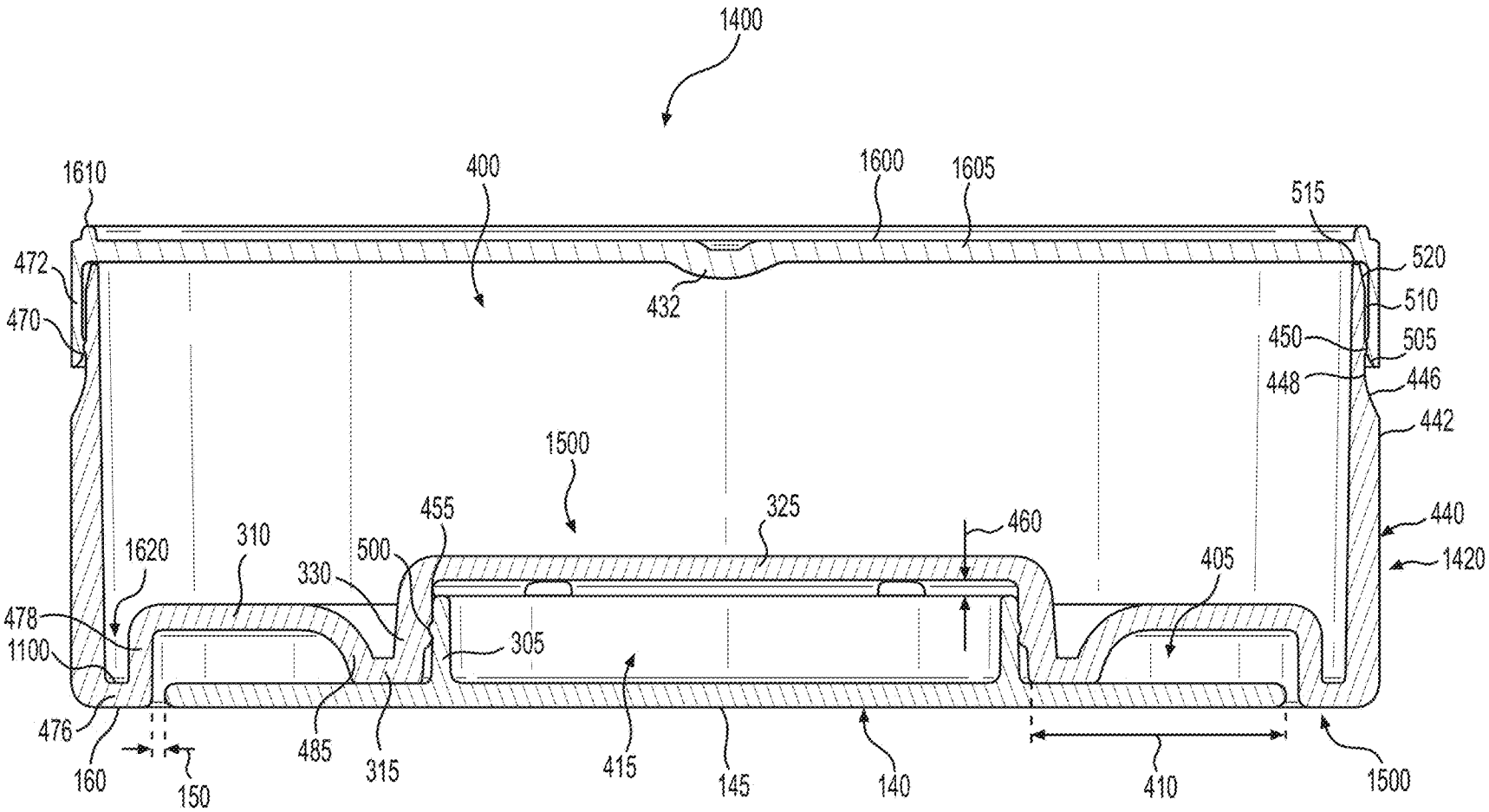
FIG. 16 is a vertical cross-sectional view of the container of FIG. 14, in accordance with at least one example embodiment.
Figure 17:
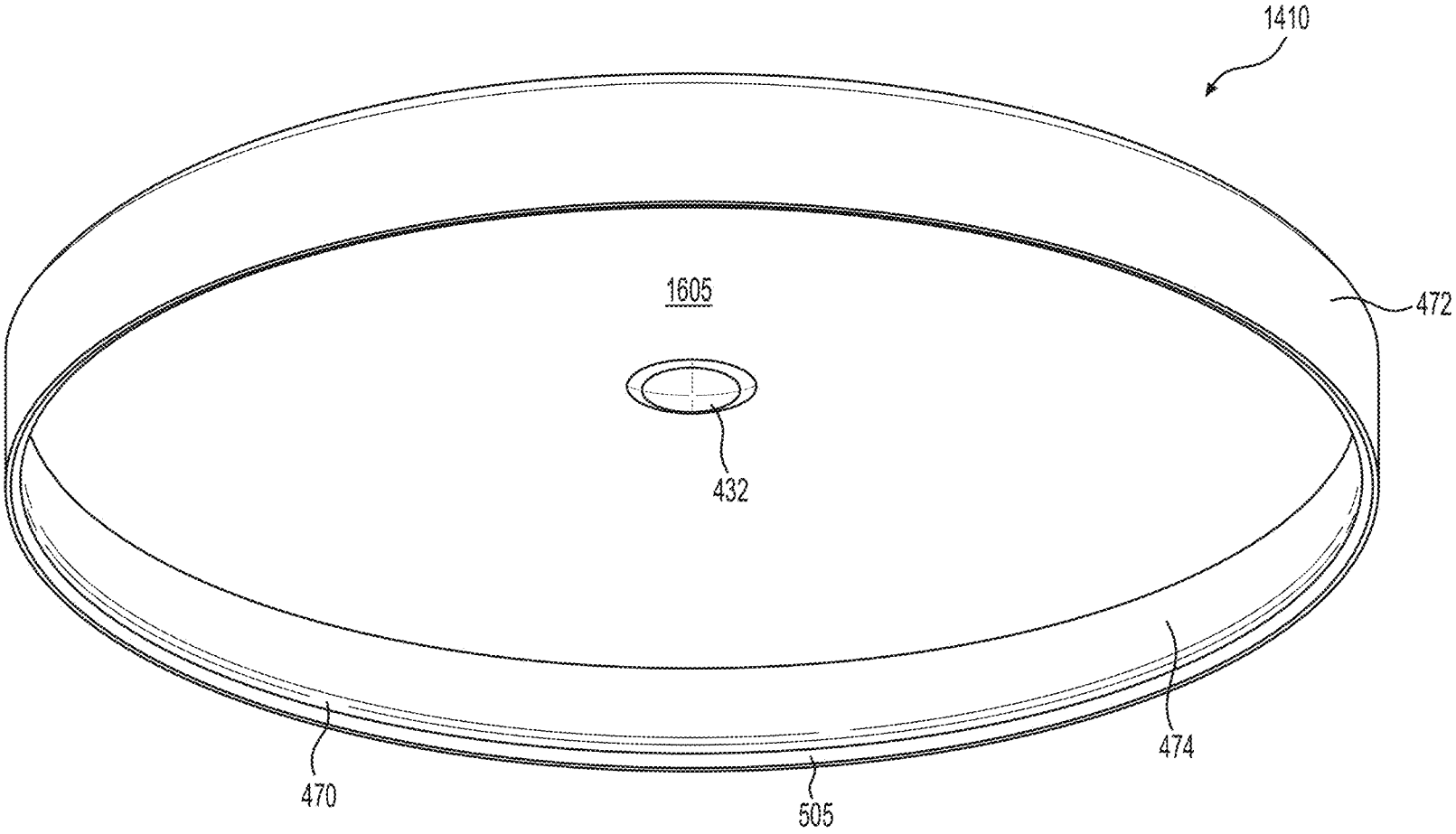
FIG. 17 is an illustration of a lower perspective view of the lid of the container of FIG. 14, in accordance with at least one example embodiment.
Figure 18:
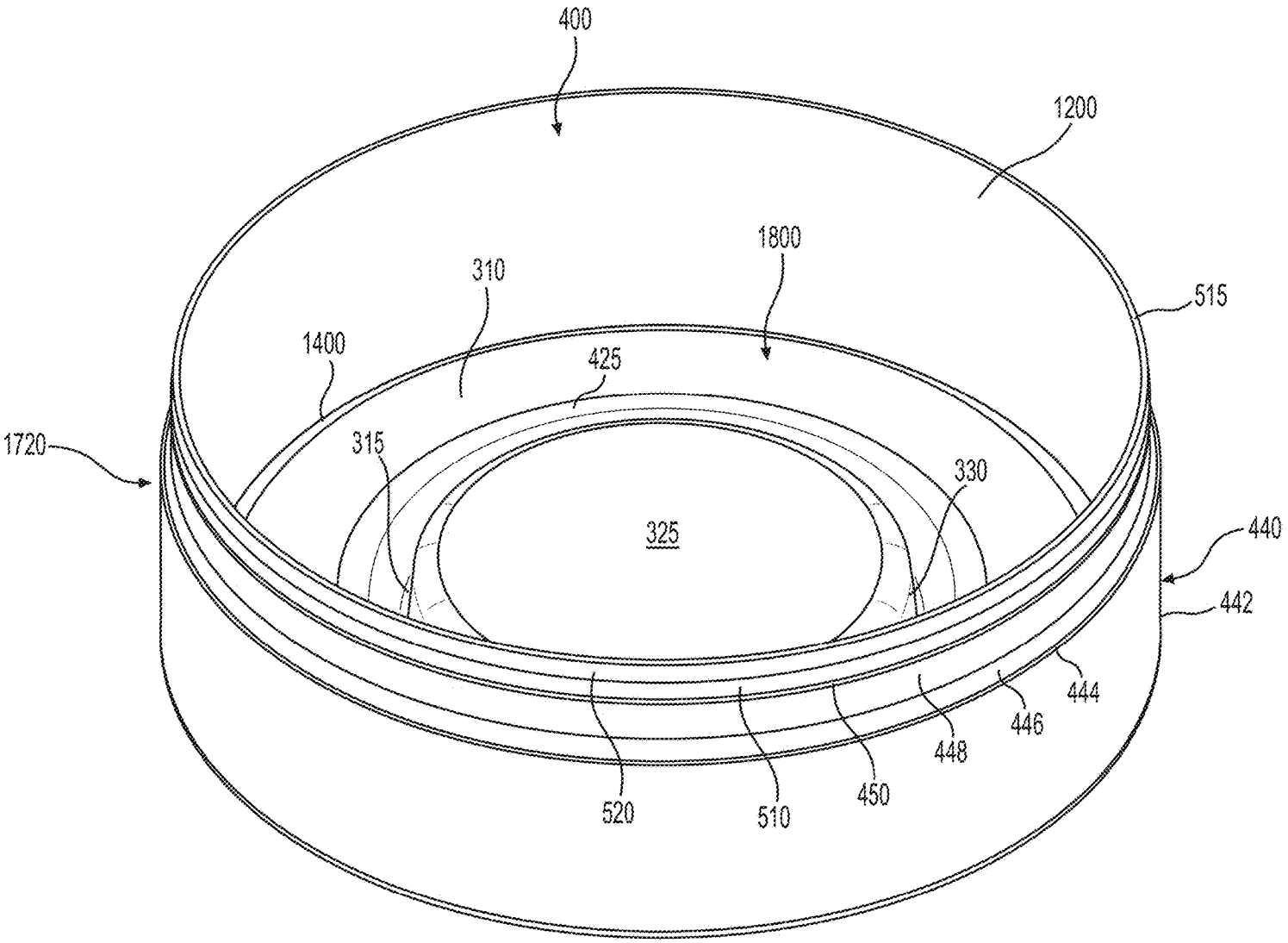
FIG. 18 is an illustration of an upper perspective view of a base of the container of FIG. 14, in accordance with at least one example embodiment.

FIG. 16 is a vertical cross-sectional view of the container 1400, in accordance with an example embodiment. FIG. 17 is an illustration of a lower perspective view of the lid 1410 of the container of FIG. 14, in accordance with an example embodiment. FIG. 18 is an illustration of an upper perspective view of the base 1720 of the container 1400, in accordance with an example embodiment.

In at least one example embodiment, the lid 1410 and the base 1720 of the container 1400 define the primary storage area 400. In at least one example embodiment, the cover 140 and the end-covering 1500 define the secondary storage area 320. In at least one example embodiment, the end-covering 1500 and the peripheral portion 410 of the cover 140 at least partially form the peripheral cavity 405.

In at least one example embodiment, the end-covering 1500 forms a lower portion (floor) of the base 1720. In this example embodiment, the secondary storage area 320 and the peripheral cavity 405 are on a lower portion of the container 1400. In at least one example embodiment, the end-covering 1500 is integrally formed with the main sidewalls 440, such that the end-covering 1500 cannot be removed from the remainder of the base 1720. In at least another example embodiment, the end-covering 1500 is able to be detached from the lower portion of the container 1400, where the end-covering 1500 is connected to the main sidewalls 440 in a same manner as the end-covering 130 (see FIG. 4). In at least one example embodiment, the annular wall 476 of the end-covering 1500 is integrally formed to be connected to the main sidewall 440 of the base 1720.

In at least one example embodiment, the annular surface 160 of the end-covering 1500 is a lower-most (end) surface of the end-covering 1500. In at least one example embodiment, the outer surface 145 of the cover 140 and the annular surface 160 of the end-covering 1500 are substantially flush with each other. In at least one example embodiment, the outer surface 145 and the annular surface 160 collectively form lower-most surfaces of the container 1400.

In at least one example embodiment, the lid 1410 includes an upper wall (end-wall) 1605. In at least one example embodiment, the upper wall 1605 includes an annular ridge 1610 that extends from an outer surface 1600 of the upper wall 1605. In at least one example embodiment, the annular ridge 1610 extends around an upper periphery of the outer surface 1600. In at least one example embodiment, the upper wall 1605 defines the dimple 432.

In at least one example embodiment, the base 1420 includes the end-covering 1500 that is joined to the main sidewall 440. In at least one example embodiment, the inner surface 1100 of the annular wall 476 (FIG. 16) forms a valley 1620 along a lower periphery of the inner surface 900 of the main sidewall 440. In at least one example embodiment, the central floor 325 of the end-covering 1500 extends upward into the primary storage area 400 to a higher elevation relative to the secondary floor 310 (see FIGS. 16 and 18).

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

I claim:

1. A container, comprising:

a main sidewall;

a first end-wall connected to a first end of the main sidewall; and a first structure, a first side of the first structure being connected to a second end of the main sidewall, the main sidewall, the first end-wall and the first structure at least partially defining a primary storage area, the first structure including a secondary sidewall extending from a second side of the first structure; and a cover, the cover including a protrusion extending from a first side of the cover, the protrusion being inserted within the secondary sidewall to be releasably mated with the secondary sidewall, a first central portion of the cover and a second central portion of the first structure at least partially defining a secondary storage area, a first peripheral portion of the cover and a second peripheral portion of the first structure at least partially defining a peripheral cavity, the peripheral cavity being symmetrically defined around an entire periphery of the secondary storage area.

2. The container of claim 1, wherein the first central portion includes the protrusion and a first central end-wall of the cover, and the second central portion includes the secondary sidewall and a second central end-wall of the first structure.

3. The container of claim 1, wherein the protrusion is configured to be removable from within the secondary sidewall to selectively detach the cover from the first structure to allow access for the secondary storage area.

4. The container of claim 1, wherein the cover is configured to be selectively removable from the first structure to allow access for the secondary storage area.

5. The container of claim 1, wherein the first peripheral portion includes a brim of the cover, and the second peripheral portion includes a secondary end-wall, a first wall and a second wall, the first wall and the second wall extending from respective ends of the secondary end-wall.

6. The container of claim 5, wherein the first structure includes an annular surface on a distal end of the second wall, a second side of the cover being flush with the annular surface.

7. The container of claim 6, wherein a first gap is defined between a distal-most end of the cover and the second wall.

8. The container of claim 1, wherein the first structure includes an annular surface on a peripheral end of the first structure, and the annular surface is flush with a second side of the cover.

9. The container of claim 1, wherein the first peripheral portion is suspended above at least a portion of the peripheral cavity.

10. The container of claim 1, wherein the first structure includes an annular ridge between the secondary storage area and the peripheral cavity, the secondary sidewall being connected to the annular ridge.

11. The container of claim 10, wherein the first peripheral portion spans across the annular ridge and is suspended above the peripheral cavity.

12. The container of claim 11, wherein the peripheral cavity is configured to allow a first upper edge of a second side of the cover, at any location along a periphery of the cover, to be pressed in an inward direction toward and into the peripheral cavity to cause a first end of the cover to rise, as the annular ridge acts as a fulcrum that provides a counteracting force against the first side of the cover, to assist in detaching the cover from the first structure, the first upper edge and the first end being on opposite sides of the cover.

13. The container of claim 12, wherein a gap exists between a distal-most end of the protrusion and a second central end-wall of the first structure to allow the cover and the protrusion to pivot as the first upper edge is pressed in the inward direction.

14. The container of claim 11, wherein the peripheral cavity is an annularly shaped cavity that is around a periphery of the secondary storage area.

15. The container of claim 13, wherein an outer surface of the protrusion defines an annular ridge and an inner surface of the secondary sidewall includes at least one lug, the at least one lug being configured to mate with the annular ridge to hold the cover on the first structure.

16. The container of claim 1, wherein the protrusion is a cylindrically shaped wall that is hollow.

17. The container of claim 1, wherein the main sidewall and the first end-wall collectively form a base, and the cover and the first structure collectively form a lid, the lid being configured to be removed from the base to allow access to the primary storage area.

18. The container of claim 1, wherein the main sidewall and the first structure collectively form a base.

19. The container of claim 18, further comprising:

outer sidewalls extending from the first end-wall, the outer sidewalls and the first end-wall collectively forming a lid, the lid being configured to be removed from the base to allow access to the primary storage area, the first structure and the lid being on opposite ends of the container.

20. The container of claim 1, further comprising:

oral consumer products contained within the primary storage area.

* * * * *